United States Patent [19]

Herlem et al.

[11] 3,996,116

[45] Dec. 7, 1976

[54] PROCESS FOR THE CONVERSION OF STRAIGHT CHAIN SATURATED HYDROCARBONS

[75] Inventors: Michel Paul Herlem; Francis Bobillard; André Thiebault, all of Paris, France

[73] Assignee: Agence Nationale de Valorisation de la Recherche (ANVAR), Neuilly-sur-Seine, France

[22] Filed: May 20, 1975

[21] Appl. No.: 579,189

[52] U.S. Cl. ..... 204/59 R; 204/72; 260/683.65

[51] Int. Cl.[2] ..... C25B 3/00; C07C 5/22

[58] Field of Search ..... 204/59 R, 72; 260/683.65

[56] References Cited

OTHER PUBLICATIONS

Olah et al., J. Amer. Chem. Soc., vol. 90, No. 10, pp. 2726–2727, 5–68.

*Primary Examiner*—F.C. Edmundson

*Attorney, Agent, or Firm*—Burgess, Dinklage & Sprung

[57] ABSTRACT

The present invention relates to a new process for converting straight chain saturated hydrocarbons into other saturated hydrocarbons, notably branched chain hydrocarbons. It consists in submitting these products to oxidation in liquid phase in the presence of a superacid such as $HFSO_3$, the oxidizing agent being $SO_3$ and/or an electric current. Straight chain saturated hydrocarbons containing 4 to 12 carbon atoms undergo polymerization to form hydrocarbons of higher molecular weight.

9 Claims, 2 Drawing Figures

PROCESS FOR THE CONVERSION OF STRAIGHT CHAIN SATURATED HYDROCARBONS

The present invention relates to a new process for converting straight chain saturated hydrocarbons into, notably, branched chain saturated hydrocarbons.

It is known (cf. Journal of the American Chemical Society, 25 July 1973 Vo. 95, pages 4960 ff) that when alkanes in excess are treated with superacids oligocondensations are obtained all the more easily the higher the number of carbon atoms and that, according to the temperature and nature of the superacid used, the reaction corresponds in a variable proportion to the rupture of C—H or C—C bonds and to the formation of varying types of alkylcarbonium ions.

It has been reported, for example, that methane can react on $FSO_3H—SbF_5$ to give $CH_5^+$ and $CH_3^+$ ions, the latter reacting with $CH_4$ to give the $C_2H_7^+$ ion, said reaction constituting the start of a series of polymerizations; higher molecular weight hydrocarbons, on the contrary, more likely undergo cracking (Journal of the American Chemical Society, 8th May 1968, Vol. 90, pages 2726–2727).

In practice, research workers have tried various compounds or mixtures likely to induce the formation of alkylcarbonium ions: boron trifluoride, tin tetra and pentachlorides antimony pentachloride have been studied, notably by Byrne, Olah and Nakane, without really conclusive results. Antimony pentafluoride, on the contrary, gave interesting results, either pure or diluted with $SO_2$, sulfuryl fluoride or fluorochloride, or else in combinations such as $HFSO_3—SbF_3$, $HF—SbF_5$.

Compounds such as HF, $BF_3$, $HF—TaF_5$ or fluorosulfuric acid have also been tried, but these products are considered to be less interesting (cf. Angewandte Chemie Vol. 12 No. 3, March 1973, International Edition, p. 180).

Experiments with $H_2SO_4$ in oleum (N.C. Deno, Progr. Phys. Org. Chem. Vol. 2, 1964, page 129) demonstrated that saturated hydrocarbons could be obtained by polymerization and cyclopentyl cations, but the existance of stable and well defined alkyl-carbonium ions, likely to lead to branched chain hydrocarbons, has not been proved.

Previous experiments therefore demonstrate that antimony pentafluoride is the most advantageous product for obtaining such reactions.

Unfortunately, the product is costly, corrosive and toxic, which limits the possibility of passing from research laboratories to industrial applications.

The present invention provides a process for converting straight chain saturated hydrocarbons which only requires cheap, easy to obtain reagents, and which pose problems of corrosion and health which can be solved by well known methods. This process moreover provides advantageous yields.

The process of the invention consists in operating in solution in fluorosulfuric acid or chlorosulfuric acid, either by the chemical method using $SO_3$ to partially oxidize the hydrocarbons, or by electrolysis or by a combination of the two methods.

Figure 1:
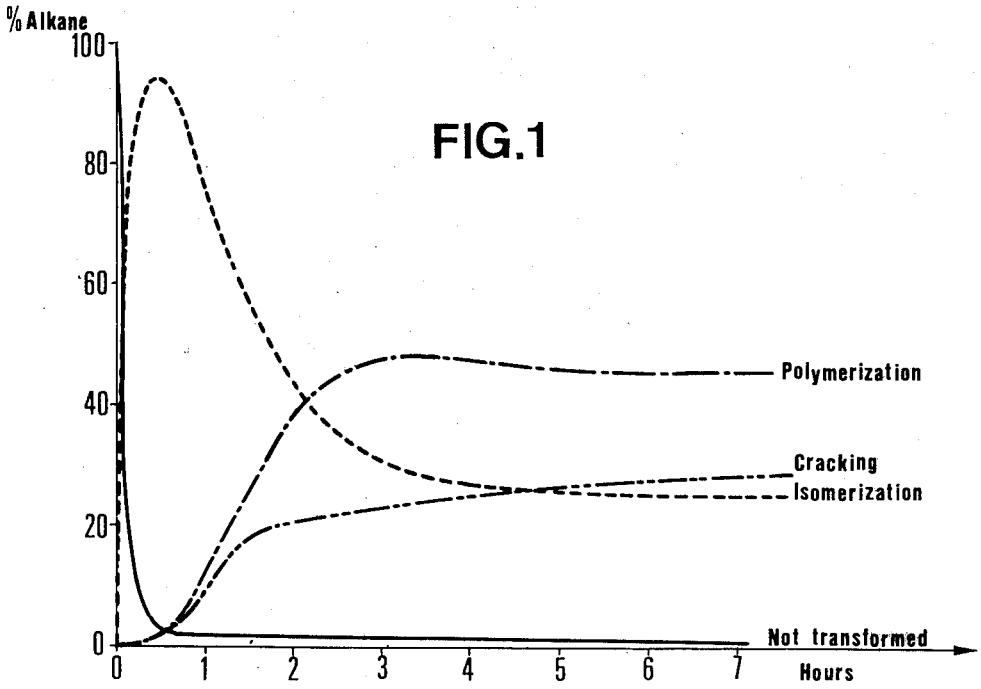
Figure 2:
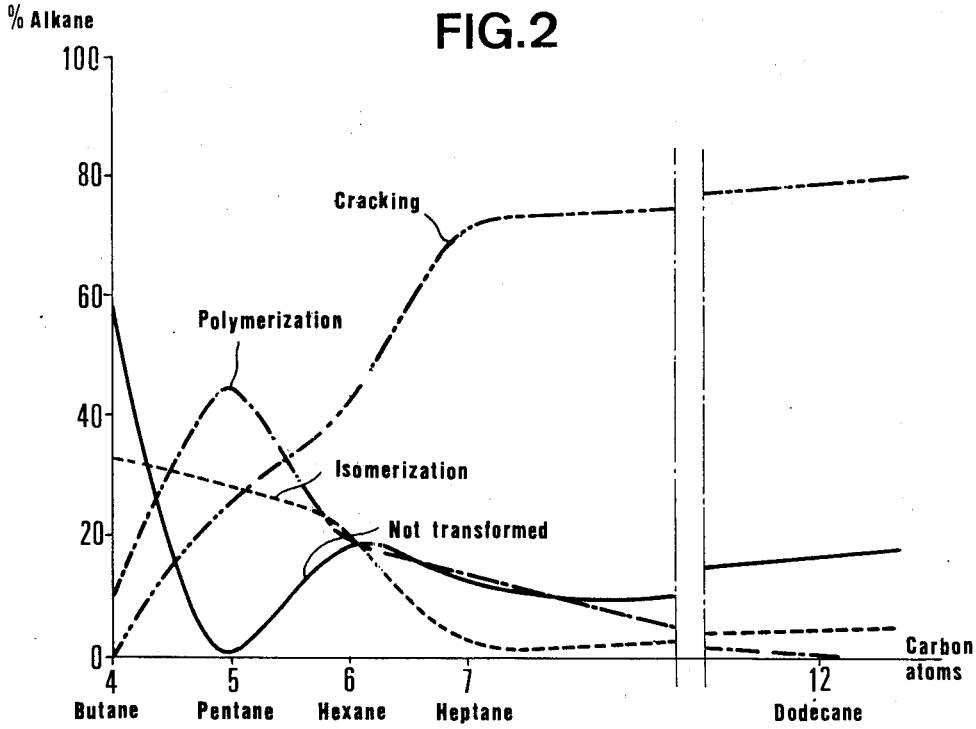

It will be described below with reference, notably, to the figures among which:

FIG. 1 is a diagram of the evolution of the reaction of n-pentane with fluorosulfuric acid as a function of time; and FIG. 2 is a diagram of the behavior of n-alkanes in fluorosulfuric acid as a function of the number of carbon atoms they contain.

At ordinary temperature, fluorosulfuric acid contains about 0.1 % by weight of $SO_3$, owing to the equilibrium of the dissociation reaction:

$$HFSO_3 \rightleftharpoons SO_3 + HF$$

This rate is sufficient to enable appreciable results to be obtained by the chemical method, but it has been discovered that if a sufficient amount of $SO_3$ is added to bring the amount of free $SO_3$ to 0.3 to 3 % by weight, substantially better results are obtained, as will be seen below.

As chlorosulfuric acid has a formation heat of 143 kcal/mole, lower by 46 kcal/mole than that of fluorosulfuric acid (189 kcal/mole), it is a much more important $SO_3$ donor than the latter acid ($HSO_3F$).

As a result, a violent reaction occurs with the hydrocarbons; it was discovered that it was possible to obtain controlled oxidation by partially neutralizing $SO_3$, for example, with an alkaline salt such as KCl, with which it forms $KSO_3Cl$. The free $SO_3$ content is thus advantageously reduced to 0.3 to 2 % by weight.

It is therefore necessary to neutralize a portion of the excess $SO_3$ which can be done with a salt such as KCl, with which $KSO_3Cl$ is formed.

When the operation is effected by electrolysis, it is unnecessary to increase the $SO_3$ content in $HFSO_3$, and it is even advantageous to partially neutralize it with an alkaline salt. The same thing obviously applies to $HClSO_3$.

In order to avoid selective conditions, the voltages used should preferably lie on the plateau of the curve giving the intensity as a function of the anodic tension, designated hereinafter as the anodic wave plateau.

It has been established that, by chemical means, it is possible to obtain similar or better results than those obtained with the mixtures $HFSO_3—SbF_3$, as is seen from table 1 which gives the results of trails conducted at ordinary temperature on pentane, with recycling of light products.

TABLE 1

| Reagent | acid/hydrocarbon (by volume) | Time | + light | + heavy | $R = \frac{+\text{heavy}}{+\text{light}}$ |
|---|---|---|---|---|---|
| | | Oh 10 | 1.1. | 0.6 | 0.5 |
| $SbF_5$ | 6/100 | 1h 45 | 26.0 | 26.0 | 1 |
| $HFSO_3$ mole to mole | | 24h | 24.0 | 20.0 | 0.8 |
| | | 1h 45 | 18.0 | 31.3 | 1.7 |
| $HFSO_3$ | 10/3 | 3h 25 | 23 | 48 | 2.1 |
| 0.3% by weight of $SO_3$ | | 7h | 27.7 | 46.4 | 1.7 |
| id | 1/10 | 24h | 15.3 | 22 | 1.4 |

TABLE 1-continued

| Reagent | acid/hydrocarbon (by volume) | Time | + light | + heavy | $R = \frac{+\text{heavy}}{+\text{light}}$ |
|---|---|---|---|---|---|
| | | 48h | 13.5 | 27 | 2.0 |

It should be added that the above figures give an incomplete idea of the extent of the reactions, as an important portion of the starting hydrocarbon is converted into its isomer: more than 90 % in the case of $SbF_5$—$HFSO_3$ and $HFSO_3 + SO_3$ with acid:hydrocarbon = 10:3, about 10 % in the case of $HFSO_3 + SO_2$ with acid:hydrocarbon = 1:10.

In particular, the development as a function of time of the reaction of n-pentane and $HFSO_3$ with a ratio acid:hydrocarbon of 10:3 by volume at ordinary temperature, is given in FIG. 1. The proportion of unconverted hydrocarbon is observed to be very small after only 40 minutes.

The proportions of the products obtained were also observed to vary very substantially notably as a function of the number of carbon atoms in the starting hydrocarbon, as is shown in table 2 and FIG. 2, obtained by submitting various hydrocarbons to the action of $HFSO_3$ with 0.3 % $SO_3$ for 6 hours and without electric current, the ratio acid:hydrocarbon being 10:3 by volume, at a temperature of −10° C for n-butane and 20° C for other hydrocarbons (for butane, the steady state is not reached).

TABLE 2

| hydrocarbons | % of alkane due to cracking | % of alkane due to polymerization | % of alkane not converted | % of alkane isomerized |
|---|---|---|---|---|
| n-butane | traces | 9.7 | 57.0 | 33.2 |
| n-pentane | 26.0 | 45.0 | 1.0 | 28.0 |
| n-hexane | 41.5 | 19.2 | 18.0 | 20.5 |
| n-heptane | 71.5 | 13.5 | 12.5 | 2.5 |
| n-dodecane | 79.0 | & traces | 16.4 | 4.5 |

The influence of the nature of the reagent and the amount used for a given amount of hydrocarbon are shown in table 3 relating to the treatment of hexane at ordinary temperature for varying lengths of time.

TABLE 3

| Reagent | Ratio acid: hydrocarbon (volume) | Time | +light | +heavy | Ratio $\frac{+\text{heavy}}{+\text{light}}$ |
|---|---|---|---|---|---|
| $HFSO_3$ + NaF,2M | 10/3 | 96h | 22.3 | 12.9 | 0.57 |
| $HFSO_3$ | 10/3 | 1h 30 | 18.3 | 1.3 | 0.07 |
| 0.1% $SO_3$ | | 3H | 35.8 | 4.7 | 0.13 |
| | | 4h 30 | 41.0 | 4.8 | 0.12 |
| | | 6h | 47.0 | 7.1 | 0.13 |
| | | 7h 30 | 44.2 | 9.4 | 0.21 |
| | | 15h | 41.4 | 18.7 | 0.45 |
| id | 1/3 | 1h | 0.5 | 1.3 | 2.6 |
| | | 4h 30 | 2.5 | 2.5 | 1.0 |
| | | 6h 30 | 3.1 | 1.9 | 0.6 |
| | | 78h 40 | 23.2 | 16.7 | 0.72 |
| | | 97h | 23.2 | 16.7 | 0.72 |
| | | 126h | 23.2 | 16.7 | 0.72 |
| $HFSO_3$ 0.1% $SO_3$ | 1/15 | 24h | 5.3 | 3 | 0.56 |
| $HFSO_3$ | 10/3 | Oh 20 | 1.9 | 0.3 | 0.15 |
| 0.3% $SO_3$ | | 1h 50 | 31.9 | 8.6 | 0.27 |
| | | 3h 20 | 46.8 | 9.3 | 0.20 |
| | | 4h 30 | 47.6 | 17.3 | 0.36 |
| | | 6h 10 | 41.5 | 19.2 | 0.46 |
| $HFSO_3$ | 10/3 | 3h (1) | 6.5 | 0.1 | 0.015 |
| 2.25% $SO_3$ | | 5h 30 | 9.3 | 0.2 | 0.021 |
| | | 48h | 46.7 | 21.9 | 0.53 |
| $HFSO_3$ | 10/3 | 1h (1) | 21.0 | 2.2 | 0.1 |
| 4.5% $SO_3$ | | 2h | 23.1 | 0.8 | 0.3 |
| | | 48h | 28.5 | 1.9 | 0.07 |
| $HFSO_3$ 6.75% $SO_3$ | 10/3 | 1h (1) (2) | 4.3 | 0.1 | 0.02 |
| $HClSO_3$ KCl 0.1 M | 1/4 | 24h | & traces | 1 | — |
| $HClSO_3$ KCl 0.5 M | 1/4 | 24h | traces | 4.5 | — |
| HCl $SO_3$ KCl 1M | 1/4 | 24h | traces | & traces | — |
| HCl $SO_3$ | 1/4 | | violent reaction | | |

(1) intense heating during the reaction
(2) There is no evolution at longer contact times.

The use of a reagent containing more $SO_3$, or larger amounts of same, is seen to result in quicker, or sometimes, violent reactions, but is not necessarily favorable for obtaining a complete reaction or a favorable ratio (heavy products:light products). It is notably observed that, when the $SO_3$ content is increased to over 2.25 %, the production of heavy products decreases rapidly for the same length of time.

On the other hand, if the $SO_3$ content is decreased either to its level of 0.1 % in $HFSO_3$, or to a lower level by the addition of NaF which neutralizes it, the evolution becomes slower and the proportion of starting material converted decreases.

The economic optimum, which results from a compromise between the composition of the products obtained and the productivity of the installation, generally lies in the range of 0.3 to 3 % $SO_3$ in $HFSO_3$. .

In another connection, table 4 shows the influence of the temperature, the reagent used being $HFSO_3$ with 0.3 % free $SO_3$ and an acid:hydrocarbon ratio of 10:3 by volume, without electric current.

TABLE 4

| Hydrocarbon | Temperature | Time | % of light | % of heavy | Ratio +heavy / +light |
|---|---|---|---|---|---|
| Pentane (acid/hydro carbon = 1/10) | + 20° C | 24h | 15.3 | 22 | 1.4 |
| | | 48h | 13.5 | 27 | 2.0 |
| | + 50° C | 1h | 15.1 | 20.5 | 1.5 |
| heptane (acid/hydro carbon = 10/3) | + 20° C | 2h | 65 | 12 | 0.18 |
| | | 3h | 61.2 | 14 | 0.21 |
| | + 50° C | Oh | 60.3 | — | 0 |
| | | 2h | 67 | 5 | 0.08 |

It is seen that although a rise in temperature accelerates reactions, it does not necessarily have a favorable effect on the proportion of heavier products obtained.

If the reaction is carried out by electrolysis, it is not necessary to have a high level of $SO_3$ in the superacid, as oxidation is essentially the result of passing the electric current.

It is preferable to choose electrolysis voltages situated above the half wave tension of the hydrocarbon to be treated and below that of the superacid used as solvent.

As a guide, the electrode voltages of some straight chain non-branched hydrocarbons are given below (values measured on polished platinum electrodes compared with the Pd ($H_2$) electrode

| | | |
|---|---|---|
| n-butane | + 2.15 V | (at −40° C) |
| n-pentane | + 2.01 V | (at ambient temperature) |
| n-hexane | + 1.86 V | (at ambient temperature) |
| n-heptane | + 1.73 V | (at ambient temperature) |
| n-octane | + 1.64 V | (at ambient temperature) |
| n-nonane | + 1.57 V | (at ambient temperature) |
| n-decane | + 1.56 V | (at ambient temperature) |

It is advantageous to use at least 100 mV above these values.

The corresponding voltage for $HFSO_3$ is about 2.5V and, if higher values than this are used, more or less stable gas compounds are formed, such as $S_2O_6F_2$, which disturbs the reaction. It is advantageous to operate at a maximum of 200 mV lower than this value.

Table 5 below gives the results of a trial on hexane with a voltage of 1.9 to 2V with a platinum electrode.

TABLE 5

| Q (Coulombs) | +light | +heavy | +heavy / +light |
|---|---|---|---|
| 200 | 2.2 | — | 0 |
| 400 | 21.0 | & 0.8 | 0.04 |
| 600 | 28.4 | 2.3 | 0.08 |
| 800 | 39.1 | 5.0 | 0.13 |
| 1000 | 41.6 | 6.3 | 0.15 |
| 1300 | 41.9 | 7.6 | 0.18 |
| 1500 | 43.8 | 10.6 | 0.24 |
| 1750 | 43.1 | 13.6 | 0.31 |
| 2000 | 43.4 | 14.9 | 0.34 |

A more detailed analysis demonstrates that the level of each of the light products first increases rapidly and then reaches a limit which differs for each product. The level of each of the heavy products, on the other hand, increases slowly but in a substantially linear way to a limit for much greater amounts of electricity.

It therefore appears that a certain saturation in light products occurs and, once this is the case, essentially polymerization reactions will be obtained.

We claim:

1. A process for converting straight chain saturated hydrocarbons into branched chain saturated hydrocarbons comprising oxidizing the hydrocarbons in liquid phase in the presence of a superacid by electrolysis at a voltage in the range of between the half wave voltage of the hydrocarbon and that of the superacid.

2. A process according to claim 1, wherein oxidation is also effected with $SO_3$ the free $SO_3$ content in the superacid is in the range of 0.1 to 3 % by weight.

3. A process according to claim 2, wherein $HFSO_3$ is used as the superacid, and $SO_3$ is added in an amount sufficient to obtain the desired level.

4. A process according to claim 3, wherein the free $SO_3$ content of the superacid is in the range of 0.3 to 3 % by weight of $HFSO_3$.

5. A process according to claim 2, wherein $HClSO_3$ is used as the superacid and the excess $SO_3$ is neutralized with respect to the desired level.

6. A process according to claim 5, wherein alkaline halide is used to neutralize $SO_3$.

7. A process according to claim 1, wherein the voltage is at least 100 millivolts higher than the half wave voltage of the hydrocarbon.

8. A process according to claim 1, wherein $HFSO_3$ solution is used with a voltage in the range of 1.9 to 2.5V.

9. A process according to claim 3, wherein the hydrocarbon is pentane.

* * * * *